United States Patent [19]

Watanabe et al.

[11] Patent Number: 4,975,353

[45] Date of Patent: Dec. 4, 1990

[54] HEAT-SENSITIVE RECORDING MATERIALS

[75] Inventors: Katsuhiko Watanabe; Takekatsu Sugiyama; Sadao Ishige; Hiroshi Kamikawa, all of Shizuoka, Japan

[73] Assignee: Fuji Photo Film Co., Ltd., Kanagawa, Japan

[21] Appl. No.: 305,600

[22] Filed: Feb. 3, 1989

[30] Foreign Application Priority Data

Feb. 3, 1988 [JP] Japan ..... 63-23490

[51] Int. Cl.[5] ..... G03C 5/18

[52] U.S. Cl. ..... 430/151; 430/138

[58] Field of Search ..... 430/151, 285; 503/214

[56] References Cited

U.S. PATENT DOCUMENTS 4,187,112 2/1980 Etoh et al. ..... 430/285

4,758,495 6/1988 Yamaguchi et al. ..... 503/214

FOREIGN PATENT DOCUMENTS 1128762 10/1965 United Kingdom ..... 430/151

*Primary Examiner*—Paul R. Michl

*Assistant Examiner*—John S. Y. Chu

*Attorney, Agent, or Firm*—Sughrue, Mion, Zinn, Macpeak & Seas

[57] ABSTRACT

A heat-sensitive recording material comprising a support having provided thereon a heat-sensitive recording layer which comprises (a) a diazo compound, (b) a coupling component which forms a coloration by coupling with the diazo compound, and (c) a basic substance having a structural unit represented by Formula (I):

(I)

10 Claims, No Drawings

HEAT-SENSITIVE RECORDING MATERIALS

FIELD OF THE INVENTION

This invention concerns heat-sensitive recording materials. More particularly, it concerns diazo based heat-sensitive recording materials.

BACKGROUND OF THE INVENTION

Leuco dye type heat-sensitive recording materials are normally employed as the recording material used in a heat-sensitive recording method. However, these heat-sensitive recording materials have a disadvantage in that unexpected coloration arises as a result of rough handling, heating or contact with solvents after a recording has been made, and the recorded image is inevitably stained. Active research has been carried out in connection with diazo based heat-sensitive recording materials in recent years as heat-sensitive recording materials which are not prone to disadvantages of this sort. For example, JP-A-No. 57-123086 (the term "JP-A" as used herein means an "unexamined published Japanese patent application"), JP-A-No. 58-160190, JP-A-No. 57-169390 and JP-A-No. 59-2887, and the *Journal of the Electric Image Society,* 11, 290 (1982) etc., have disclosed the performance of thermal recording by using materials comprising a diazo compound, a coupling component and a basic component (including substances which become basic on heating). These disclosures indicate that after thermal recording is performed, the unreacted diazo compound is degraded by irradiation with light to prevent further color formation. Thus, it is possible in this way to stop color formation in the portions of the material where recording is not required (this stoppage is referred to below as "fixation").

Furthermore, JP-A-No. 59-190886 has disclosed heat-sensitive recording materials comprising microcapsules in which at least one component which takes part in the color forming reaction is included as a core material. The walls of these microcapsules are formed around this core material by polymerization in order to prevent the occurrence of pre-coupling during storage.

However, in recent years, as the range of applications for heat-sensitive recording materials has become more widespread, it has become essential to maintain a high quality recorded image over long periods of time. Even with the aforementioned diazo type heat-sensitive recording materials, it is desired that better color forming properties should be provided, that the storage stability should be improved and that the light resistance of the recorded image should be improved. It is therefore desirable that coloration of background after fixation should be slight even when fixable materials are used.

SUMMARY OF THE INVENTION

One object of the present invention is to provide heat-sensitive recording materials which have good color forming properties and excellent storage stability (i.e., shelf life stability) and image fastness, and with which there is little coloration of the background after fixation.

This and other objects of the present invention have been attained by providing a heat-sensitive recording material which comprises a support having provided thereon a heat-sensitive recording layer which contains (a) a diazo compound (b) a coupling component which forms a coloration by coupling with the diazo compound and (c) a basic substance having a structural unit represented by Formula (I):

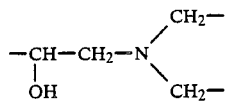

(I)

DETAILED DESCRIPTION OF THE INVENTION

The basic substance of this invention preferably has a melting point of from 60° C. to 200° C., more preferably from 80° C. to 140° C.

Furthermore, the basic substance of this invention is preferably sparingly soluble in water in order to reduce pre-coupling during storage. Preferably, this basic substance has excellent compatibility with the coupling component so that the color forming properties are improved.

Preferably, the basic substance of this invention is represented by Formula (II):

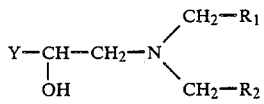

(II)

wherein Y represents an alkyl group, an aryl group, or an aralkyl group, which groups may be substituted or unsubstituted; and $R_1$ and $R_2$ each represents an alkyl group, an aryl group, or an aralkyl group, which groups may be substituted or unsubstituted; and $R_1$ and $R_2$ may be joined together to form a ring, in which case the joined ring may contain a hereto atom.

More preferably, the basic substance of this invention is represented by Formula (III):

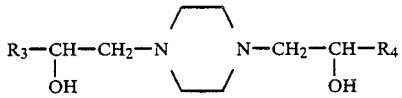

(III)

wherein $R_3$ and $R_4$ each represents an alkyl group, an aryl group, or an aralkyl group, which groups may be substituted or unsubstituted.

Still more preferably, the basic substance of this invention contains an ether bond or a thioether bond as shown in Formula (IV):

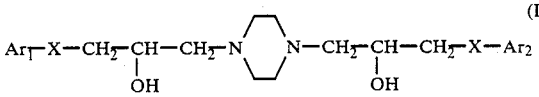

(IV)

wherein X represents O or S, preferably O; and $Ar_1$ and $Ar_2$ each represents a phenyl or a naphthyl group, which groups may be substituted or unsubstituted.

Moreover, as the basic substances of this invention, those which can be represented by Formula (V) indicated below are also more preferred.

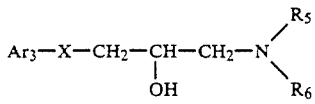

(V)

wherein X represents O or S; $Ar_3$ represents a phenyl group or a naphthyl group, which groups may be substituted or unsubstituted; $R_5$ and $R_6$ each represents an alkyl group, an aryl group, or an aralkyl group, which groups may be substituted or unsubstituted; and $R_5$ and $R_6$ may be joined together to form a ring, in which case the joined ring may contain a hetero atom, and rings such as the morpholine ring and the piperazine ring are preferred for the heterocyclic ring.

Examples of substituents for the alkyl, aryl and aralkyl groups represented by Y, $R_1$, $R_2$, $R_3$, $R_4$, $R_5$ or $R_6$, and the phenyl and naphthyl groups represented by $Ar_1$, $Ar_2$, or $Ar_3$ in the above Formulae (II) to (V) include an alkyl group, an alkoxy group, an alkylthio group, a halogen atom, an alkoxycarbonyl group, a carbamoyl group, an alkylsulfonyl group, an ureido group, a cyano group, an acylomino group, an amino group, etc.

Among these basic substances of this invention which are represented by Formulae (II) to (V), the compounds represented by the Formula (IV) are particularly preferred.

Preferred illustrative compounds for the basic substance of the present invention are indicated below, but this invention is not limited thereto.

(1) N,N'-Bis(3-phenoxy-2-hydroxypropyl)piperazine
(2) N,N'-Bis[3-(p-methylphenoxy)-2-hydroxypropyl]-piperazine
(3) N,N'-Bis[3-(p-methoxyphenoxy)-2-hydroxypropyl]-piperazine
(4) N,N'-Bis(3-phenylthio-2-hydroxypropyl)piperazine
(5) N,N'-Bis[3-(β-naphthoxy)-2-hydroxypropyl]piperazine
(6) N-3-(β-naphthoxy)-2-hydroxypropyl-N'-methylpiperazine
(7) N-[3-(β-naphthoxy)-2-hydroxy]propylmorpholine
(8) 1,4-Bis[(3-morpholino-2-hydroxy)propyloxy)benzene
(9) 1,3-Bis[(3-morpholino-2-hydroxy)propyloxy)benzene
(10) 1,4-Bis{[3-(N-methylpiperazino)-2-hydroxy]-poropyloxy}benzene Furthermore, two or more of these basic substances may be used in combination and they can also be used in combination with other known sparingly water soluble or water insoluble basic substances or substances which produce an alkali substance when heated. Hereinafter, these "other known basic substances" are referred to as "auxiliary basic substances". The amount of these auxiliary basic substances included is not more than 60% by weight, preferably 10 to 50% by weight, per the weight of the basic substance of this invention.

Of the aforementioned auxiliary basic substances, the guanidines, the imidazolines, and the amidines are preferred.

Diazo compounds to be used in the present invention may be diazonium salts represented by the formula $ArN_2^+X^-$, wherein Ar'' represents an aromatic moiety, $N_2^+$ represents a diazonium group, and X-represents an acid anion and are compounds that can give rise to a coupling reaction with a coupling component and are capable of being decomposed by light, preferably an oil-soluble compound.

An example of a preferred aromatic moiety is one having the formula (VI):

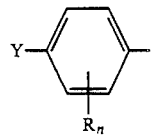

(VI)

wherein Y represents a hydrogen atom, a substituted amino group, a nitrogen atom of a nitrogen atom-containing ring, an alkoxy group, an aryloxy group, an arylthio group, an alkylthio group or an acylamino group, and R represents a hydrogen atom, an alkyl group, an alkoxy group an aryloxy group, an arylamino group or a halogen atom (I, Br, Cl, or F). n represents 1 or 2.

When Y is a substituted amino group, the substituted amino group is preferably a monoalkylamino group, a dialkylamino group, and an arylamino group and when Y is the nitrogen atom of a nitrogen atom-containing ring, the nitrogen atom containing ring is preferably a morphilino group, a piperidino group, a pyrrolidino group, etc.

Specific examples of diazoniums that form diazonium salts include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methyoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1 4-methoxybenzoylamino-2,5-diethoxybenzene, 4-diazo-1-pyrrolidino-2-ethylbenzene, etc.

Specific examples of acid anions represented by $X^-$ include $C_nF_{2n+1}COO^-$ wherein n is an integer of from 3 to 9, $C_mF_{2m+1}SO_3^-$ wherein m is an integer of from 2 to 8, $(C_pF_{2p+1}SO_2)_2CH^-$ wherein p is an integer Of from 1 to 18,

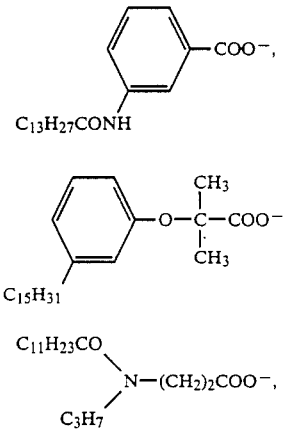

-continued

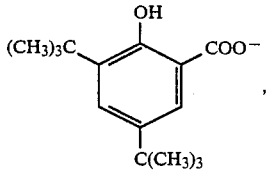

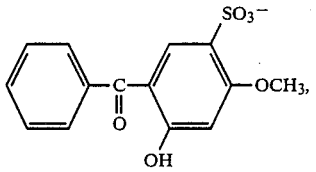

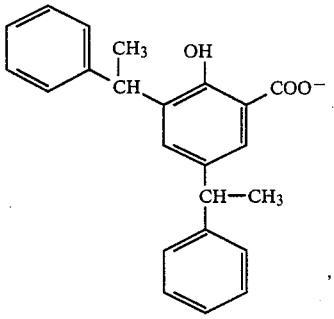

-continued

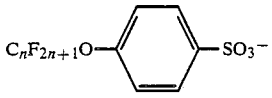

(wherein n is an integer of from 3 to 9),

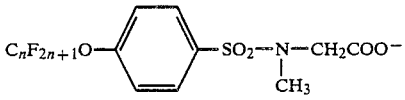

(wherein n is an integer of value from 3 to 9), and $ZnCl_3^-$, $B(\text{—}\bigcirc\text{—})_4^-$, $BF_4^-$, $PF_6^-$, etc.

Acid anions containing a perfluoroalkyl group, or a perfluoroalkenyl group or $PF_6^-$ are preferred because their use reduces the amount of fogging due to storage before heat recording.

Specific, non-limiting examples of diazonium compounds (diazonium salts) are indicated below.

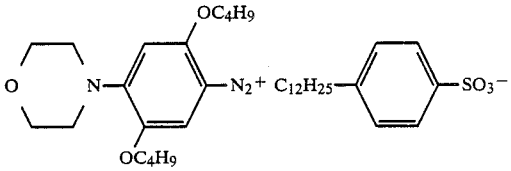

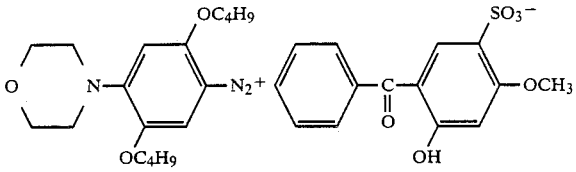

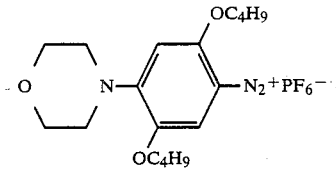

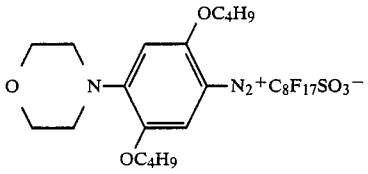

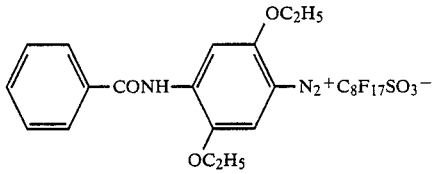

-continued
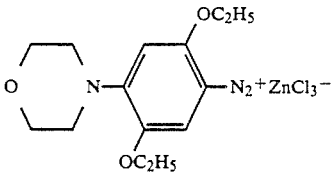
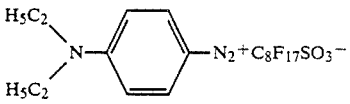
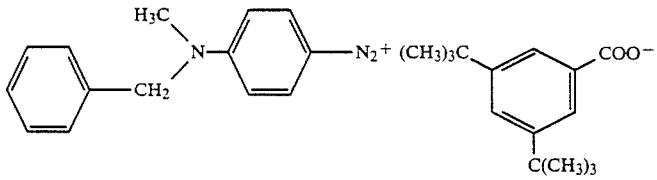
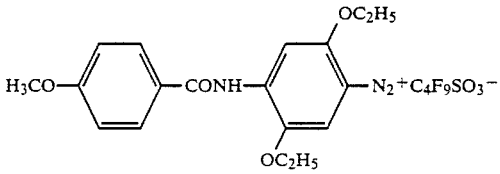
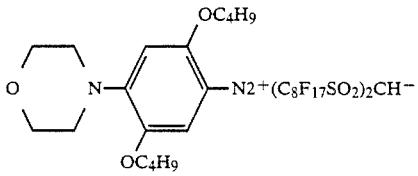
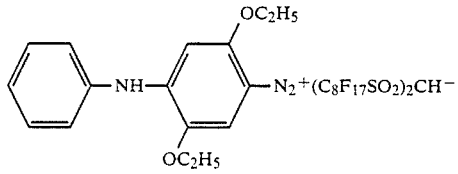
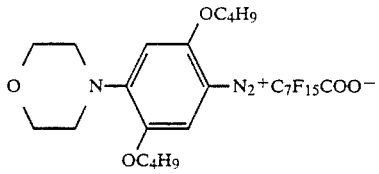
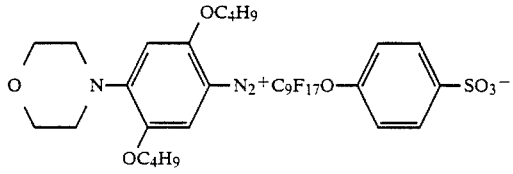
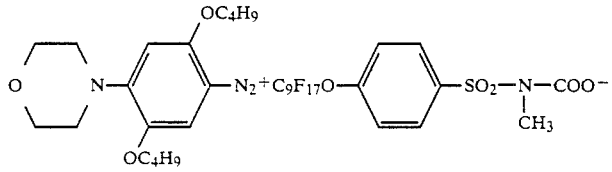
Coupling components used in the present invention are those that can form dyes when they are coupled with a diazo compound (diazonium salt) in a basic environment. Specific examples thereof include resorcin, phloroglucin, sodium 2,3-dihydroxynaphthalene-6-sulfonate, 1-hydroxy-2-naphthoic acid morpholinopropylamide, 1 5-dihydroxynaphthalene, 2,3-dihydroxynaphthalene, 2 3-dihydroxy-6-naphthalene sulfonic acid anilide, 2-hydroxy-3-naphthoic acid morpholinopropylamide 2-hydroxy-3-naphthoic acid anilide, 2-hydroxy-3-naphthoi acid-2'-methylanilide, 2-hydroxy-3-naphthoic acid ethanolamide, 2-hydroxy-3-naphthoic acid octylamide, 2-hydroxy-3-naphthoic acid-N-dodecyloxypropylamide, 2-hydroxy-3-naphthoic acid tetradecylamide, acetanilide, acetoacetanilide, benzoylacetanilide, 1-phenyl-3-methyl-5-pyrazolone 1-(2',4',6'-trichlorophenyl)-3-benzamido-5-pyrazolone 1-(2',4',6'-trichlorophenyl)-3-anilino-5-pyrazolone, 1-phenyl-3-phenylacetamido-5-pyrazolone, etc. A combination of two or more of these coupling components can be used to obtain an image having an arbitrary tone Furthermore, the incorporation of at least one aromatic ether or ester, alcohol, phenol, or acid amide (e.g. sulfonamide) in the color forming layer of the present invention is preferable for (i) improving the storage stability before recording (ii) improving the thermal color forming properties, and (iii) mitigating the reduction of the optical density of the recorded image during long term storage after thermal recording is performed.

The aforementioned aromatic ethers can be represented by the formula Ar—O—R, and specific, non-limiting examples thereof include:

(1) 2-Benzyloxynaphthalene
(2) 1-p-Biphenyloxy-2-phenylethane
(3) 2-p-Chlorobenzyloxynaphthalene
(4) 1,2-Diphenoxyethane
(5) 1-phenoxy-2-p-chlorophenoxyethane
(6) p-Biphenyl-β-methoxyethyl ether
(7) p-Biphenyl-β-cyclohexyloxyethyl ether The aforementioned ester compounds are represented

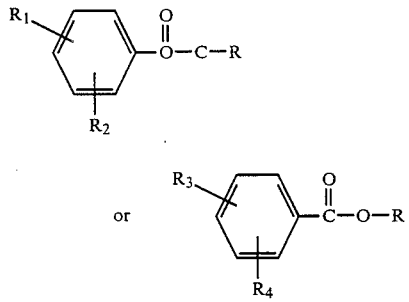

wherein $R_1$, $R_2$, $R_3$ and $R_4$, which may be the same or different, each represent a hydrogen atom, an alkyl group, an alkoxy group, an aryloxy group, an acyl group, a halogen atom, a cyano group, an aryl group, an alkyloxycarbonyl group or an aryloxycarbonyl group. Furthermore, $R_1$ and $R_2$, or $R_3$ and $R_4$, may be joined together to form a ring.

The substituent group represented by R is most preferably an alkyl group having from 1 to 10 carbon atoms which may be substituted with an alkoxy group, an aryloxy group, a halogen atom or an aryl group, or an aryl group having from 6 to 12 carbon atoms which may be substituted with an alkyl group, an alkoxy group, a hydroxyl group or a halogen atom.

Specific, non-limiting examples of the esters include:

(1) 2-Benzoyloxynaphthalene
(2) 1,2-Bis(β-phenoxyethoxycarbonyl)ethane
(3) 1,4-Bis(β-phenoxyethoxycarbonyl)butane
(4) 1-p-Methylbenzoyloxy-2-p-biphenyloxyethane
(5) 1-Hydroxy-2-phenoxycarbonylnaphthalene The aforementioned alcohols can be represented by:

R—OH wherein R is a substituted or unsubstituted alkyl group which may have a linear or branched chain and may be cyclic or unsaturated. R may be substituted with one or more halogen atoms, an acyl group, an alkoxy group, a hydroxyl group, an aryl group, an aryloxy group, an alkoxycarbonyl group, an acylamino group, a cyano group, a nitro group or an acyloxy group. Specific, non-limiting examples of these alcohols include p-xylenol, m-xylenol, hydroxybenzyl alcohol, hydroxyphenethyl alcohol, p-methoxyphenoxyethanol, perhydrobisphenol A, naphthylenediol, methylxylylenediol, or methoxyxylylenediol.

The aforementioned phenols can be represented by the formula Ar-OH, and specific, non-limiting examples thereof include p-t-butylphenol, p-t-octylphenol, p-α-cumylphenol, p-t-pentylphenol, 2,5-dimethylphenol, 2,4,5-trimethylphenol, 3-methyl-4-iso-propylphenol, p-benzylphenol, o-cyclohexylphenol, p-(diphenylmethyl)phenol, p-benzyloxyphenol, or 2,6-bis(hydroxymethyl)-p-cresol.

The aforementioned acid amides are carboxylic acid amides or sulfonic acid amides, and the arylcarboxylic acid amides and aryl sulfonic acid amides are especially preferred.

Specific, non-limiting examples of the aforementioned acid amides include the arylcarboxylic acid amides and arylsulfonic acid amides indicated below.

Arylcarboxylic acid amides:

(1) Benzamide
(2) Ethylbenzamide
(3) iso-Propylbenzamide
(4) Dimethylbenzamide
(5) Chlorobenzamide
(6) Methoxybenzamide Arylsulfonic acid amides:

(1) Ethylbenzenesulfonamide
(2) o-Toluenesulfonamide
(3) o-Methoxybenzenesulfonamide
(4) Chlorobenzenesulfonamide
(5) Ethoxybenzenesulfonamide
(6) p-Toluenesulfonamide When the heat-sensitive recording papers of this invention are constructed using the microencapsulation method, the core substance of the microcapsules is dissolved or dispersed with an insoluble organic solvent in water and emulsified, after which the microcapsule walls are formed around the dispersion. The use of an organic solvent which has a boiling point of at least 80° C. is preferred. Specific, non-limiting examples thereof include phosphate esters, phthalate esters, other carboxylic acid esters, aliphatic acid amides, alkylated biphenyls, alkylated terphenyls, chlorinated paraffins, alkylated naphthalenes and diarylethanes. Specific, non-limiting examples include tricresyl phosphate, trioctyl phosphate, octyl diphenyl phosphate, tricyclohexyl phosphate, dibutyl phthalate, dioctyl phthalate, dilauryl phthalate, dicyclohexylphthalate, butyl oleate, diethyleneglycol dibenzoate, dioctyl sebacate, dibutylsebacate, dioctyl adipate, trioctyl trimellitate, acetyl triethyl citrate, octyl maleate, dibutyl maleate, isopropylbiphenyl, isoamylbiphenyl, chlorinated paraffins, diisopropylnaphthalene, 1,1'-ditolylethane, 2,4-di-tertaminophenol and N,N-dibutyl-2-butoxy-5-tert-octylaniline. Among these materials, dibutyl phthalate, tricresyl phosphate, diethyl phthalate and dibutyl maleate, are preferred.

The microcapsule of the present invention is prepared by emulsifying the core substance containing reactive substances and thereafter forming a wall made of a high molecular weight substance around the oil drop. The reactant which forms a high molecular weight substance is added inside and/or outside of the oil drop.

Specific examples of such high molecular weight substances are polyurethane, polyurea, polyamide, polyester, polycarbonate, urea-formaldehyde resin, a melamine resin, polystyrene, styrene-methacrylate copolymer, styrene-acrylate copolymer, gelatin, polyvinyl pyrrolidone and polyvinyl alcohol.

The high molecular weight substances can be used in combination. Preferred high molecular weight substances are polyurethane, polyurea, polyamide, polyester and polycarbonate, and the most preferred substances are polyurethane and polyurea.

For preparing the wall of a microcapsule of the present invention, the method of microencapsulation by polymerizing reactants from the inside of an oil drop is most effective. That is, in accordance with the above method, a capsule which is preferably used for a recording material having good shelf life stability before recording and having uniform particle size can be prepared in a short time with such a method.

The above method and specific examples of the compounds are disclosed in U.S. Pat. Nos. 3,726,804 and 3,796,669.

When polyurethane is used as a material for the wall, the microcapsule wall is prepared by mixing polyhydric isocyanate and a second substance which forms a capsule wall by the reaction with polyhydric isocyanate, such as a polyol or amino alcohol, in the oily liquid to be encapsulated, emulsifying and dispersing the mixture in water and causing a reaction to form a polymeric wall on the surface of an oil drop by increasing the temperature. In this case, an auxiliary solvent having a low boiling point and having high dissolving power can be used in oily liquid.

In this instance, polyisocyanate and the second substance to be reacted, for example, polyol and polyamine are disclosed in U.S. Pat. Nos. 3,281,383, 3,773,695, 3,793,268, JP-B-48-40347 (corresponding to British Patent No. 1,127,338A) and JP-B-49-24159 (corresponding to U.S. Pat. No. 3,723,363) and JP-A-No. 48-80191 (corresponding to U.S. Pat. No. 3,838,108 and British Patent No. 1,423,302) and JP-A-No. 48-84086 (corresponding to British Patent No. 1,416,224). These can be used in the present invention.

Tin salt such as dibutyl tin diacetate, dibutyl tin dilaurate and dibutyl tin maleate can be used in combination with the above method.

It is preferred that polyhydric isocyanate be used as a first wall-forming substance and a polyol be used as a second wall-forming substance in order to increase shelf life stability before recording. Heat permeability of the reacted substance can be optionally varied by varying the combination of the first and the second substances.

The polyhydric isocyanate to be used as a first wall-forming substance includes diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-diphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, or cyclohexylene-1,4-diisocyanate; triisocyanate such as 4,4',4''-triphenylmethane triisocyanate or toluene-2,4,6-triisocyanate; tetraisocyanate such as 4,4'-dimethyldiphenylmethane-2,2',5,5'-tetraisocyanate; and isocyanate prepolymer such as an adduct product of hexamethylene diisocyanate and trimethylolpropane, and adduct product of 2,4-tolylene diisocyanate and trimethylolpropane, and adduct product of xylylene diisocyanate and trimethylolpropane, and an adduct product of tolylene diisocyanate and hexanetriol.

The polyol or amino alcohol as a second wall-forming substance includes aliphatic and aromatic polyhydric alcohol, hydroxypolyester and hydroxy polyalkylene ether.

Specific examples of preferred polyols include ethylene glycol, 1,3-propanediol, 1,4-butanediol, 1,5-pentanediol, 1,6-hexanediol, 1,7-heptanediol 1,8-octanediol, propylene glycol, 2,3-dihydroxybutane, 1,2-dihydroxybutane, 1,3-dihydroxybutane, 2,2-dimethyl-1,3-propanediol, 2,4-pentanediol 2,5-hexanediol, 3-methyl-1,5-pentanediol, 1,4-cyclohexanedimethanol, dihydroxycyclohexane, diethylene glycol, 1,2,6-trihydroxyhexane, phenylethylene glycol, 1,1,1-trimethylolpropane, hexanetriol, pentaerythritol, glycerin, diglyceride, phenoxy-propanediol, 1,4-di(2-hydroxyethoxy)benzene, resorcinol dihydroxyethyl ether, or a condensed product of these polyhydric alcohol and alkylene oxide, p-xylylene glycol, m-xylylene glycol, $\alpha,\alpha'$-dihydroxy-p-diisopropylbenzene and 4,4'-dihydroxydiphenylmethane, 2-(p,p'-dihydroxy-diphenylmethyl)benzyl alcohol, an adduct product of bisphenol A with ethylene oxide and an adduct product of bisphenol A with propylene oxide. The polyol is preferably used in such an amount that the hydroxyl group is present in an amount of 0.02 to 2 mols per mol of iso-cyanate group.

A water-soluble high molecular weight substance can be used to prepare a microcapsule and can be any one of water-soluble anionic high molecular weight substances, nonionic high molecular weight substances and amphoteric high molecular weight substances.

An anionic high molecular weight substance can be a natural or synthetic substance and those having $-COO^-$, $-SO_3^-$ and the like can be used. Natural anionic high molecular weight substances include gum arabic and alginic acid and semisynthetic substances include carboxymethyl cellulose, phthalated gelatin, sulfated starch, sulfated cellulose and lignin sulfonic acid.

Synthetic anionic high molecular weight substances include maleic anhydride copolymers (including hydrolysis compounds), polymers and copolymers of acrylate (including methacrylate), polymers and copolymers of vinyl benzene sulfonate, and carboxy-modified polyvinyl alcohol.

The nonionic high molecular weight substance includes polyvinyl alcohol, hydroxyethyl cellulose and methyl cellulose.

The amphoteric compound includes gelatin and the like.

These water-soluble high molecular weight substances may be used as a 0.01 to 10 wt% aqueous solution. The particle size of the microcapsules is adjusted to be 20 μm or less. Generally when the particle size thereof exceeds 20 μm, the quality of printed images becomes inferior in many cases.

Particularly when heating by a thermal head is conducted from the side of a coated layer, the particle size is preferably 8 μm or less in order to prevent fog caused by pressure from the thermal head.

In the present invention, diazo compounds, a coupling component and a basic substance, which are the main components, if necessary, may be used in the core substance of a microcapsule. Any one, two or three of the above compounds can be employed as a core material in a microcapsule, but when three of them are included in a core substance of a microcapsule, they cannot be included in one microcapsule simultaneously, but there are variable combinations of three components to be incorporated as a core material. When two of the substances are included in a core substance of a microcapsule, they may be included in separate microcapsules, respectively, or they may be included in the same microcapsules, but both diazo compounds and coupling components cannot be included in the same microcapsules.

The other components, which are not incorporated as a core material of a microcapsule, such as aromatic ether or ester, alcohol, phenol, etc. are incorporated into a heat-sensitive recording layer outside the microcapsule.

The compound of the present invention can be incorporated inside or outside of the core of a microcapsule.

A microcapsule can be prepared from an emulsion containing 0.2 wt% or more of components to be encapsulated.

Whenever one or more diazo compounds a coupling component and/or, a basic substance are included inside of microcapsules or are included in a heat-sensitive layer outside of the microcapsules, it is preferred that the coupling component is used in an amount of 0.1 to 10 parts by weight, and the basic substance is used in an amount of 0.1 to 20 parts by weight, per part by weight of diazo compounds. It is also preferred that the diazo compounds are coated in an amount of 0.05 to 5.0 g/m$^2$.

When diazo compounds, a coupling component and a basic substance are not microencapsulated, they are preferably used as a solid dispersion together with a water-soluble high molecular weight substance which are dispersed with a sand mill or the like. The preferable water-soluble high molecular weight substance used therein are those used for preparing a microcapsule. The concentration of the water-soluble high molecular weight substance is from 2 to 30 wt%, and diazo compounds, a coupling component and a basic substance are introduced into the solution of the water-soluble high molecular weight substance in an amount of from 5 to 40 wt%, respectively.

The particle size of the dispersion is preferably 10 μm or less.

Further, the heat-sensitive recording layers of the present invention can be formed as a single layer, or they can also have a multilayer structure consisting of a diazo compound layer and a coupling component layer.

Carbamic acid ester compounds and aromatic methoxy compounds can be used in the heat-sensitive recording material of the present invention in order to improve the color-forming property upon heating These compounds have the property of lowering the melting point of a coupling component or a basic substance, or improving the heat permeability of a microcapsule wall, which results in increasing the practical concentration of reactants permitted to react with one another during heating.

Specific examples of the carbamic acid ester compounds include ethyl N-phenylcarbamate, benzyl N-phenylcarbamate, phenethyl N-phenylcarbamate, benzyl carbamate, butyl carbamate, and isopropyl carbamate.

Specific examples of aromatic methoxy compounds include 2-methyoxybenzoic acid, 3,5-dimethoxyphenylacetic acid, 2-methoxynaphthalene, 1,3,5-trimethoxybenzene, p-benzyloxymethoxybenzene.

The above compounds may be used together with a core substance of a microcapsule to prepare a microcapsule, or can be added to the coating composition of a heat-sensitive recording material to be present outside of a microcapsule. It is preferred that the above compounds are used with a core substance to prepare a microcapsule.

In all cases, the additive amount of the carbamic acid ester and aromatic methoxy compounds is from 0.01 to 10 parts by weight, preferably from 0.1 to 5 parts by weight, per part by weight of coupling component. The additive amount can be optionally selected in order to adjust the desired color-forming density.

Radical generating agents (i.e., compounds which generate radicals by light irradiation) used for photopolymerization compositions can be added to the heat-sensitive recording material of the present invention in order to reduce yellow color formed on the background of the recording material after light fixation.

The radical generating agents include aromatic ketones such as benzophenone, 4,4'-bis(dimethylamino)-benzophenone, 4,4'-bis(diethylamino)benzophenone, 4-methoxy-4'-(dimethylamino)benzophenone, 4,4'-dimethoxybenzophenone, 4-dimethylaminobenzophenone, 4-methoxy-3,3'-dimethylbenzophenone, 1-hydroxycyclohexylphenyl ketone, 4-dimethylaminoacetophenone, or 2-methyl-1-[4(methylthio)-phenyl]-2-morpholinopropane-1-acetophenonebenzyl; cyclic aromatic ketones such as fluorenone, anthrone, xanthone, thioxanthone, 2-chlorothioxanthone, 2,4-dimethylthioxanthone, 2,4-diethylthioxanthone, acridone, N-ethylacridone, or benzanthrone; quinones such as benzoquinone, 2,3,5-trimethyl-6-bromobenzoquinone, 2,6-di-n-decylbenzoquinone, 1,4-naphthoquinone, 2-isopropoxy-1,4-naphthoquinone, 1,2-naphthoquinone, anthraquinone, 2-chlorcanthraquinone, 2-methylanthraquinone, 2-tert-butyl anthraquinone or phenanthraquinone; benzoins and benzoin ethers such as benzoin methyl ether, benzoin ethyl ether, 2,2-dimethoxy-2-phenylacetophenone or α-methylol benzoin methyl ether; aromatic polycyclic hydrocarbons such as naphthalene, anthracene, phenanthrene or pyrene; azo compounds such as azobisisobutyronitrile, α-azo-1-cyclohexanecarbonitrile, or azobisvaleronitrile; organic disulfides such as thiuram disulfide, and acyloxime esters such as benzyl(o-ethoxycarbonyl)-α-monooxime.

The radical generating agents are preferably used in an amount of 0.01 to 5 parts by weight, more preferably from 0.1 to 1 part by weight, per part by weight of diazonium compounds.

Thus, the formation of yellow color in the background after light fixation can be reduced by including the radical generating agents together with diazonium salts as a core substance of a microcapsule.

Further, a polymerizable compound having ethylenically unsaturated bonds (hereinafter referred to as "vinyl monomer") can also be added to the heat-sensitive recording material of the present invention in order to reduce the formation of yellow color in the background of the recording material after light fixation.

The vinyl monomer referred to herein is a compound having at least one ethylenically unsaturated bond (e.g., a vinyl group, a vinylidene group and the like) in its chemical structure, and which has a chemical form such as a monomer, or a prepolymer, namely, a dimer, a trimer, an oligomer, a mixture thereof and a copolymer thereof. Specific examples thereof include unsaturated carboxylic acids and salts thereof, esters of unsaturated carboxylic acids and aliphatic polyhydric alcohol compounds, amides of unsaturated carboxylic acids and aliphatic polyhydric amine compounds and the like.

The vinyl monomer may be used in an amount of from 0.2 to 20 parts by weight, preferably from 1 to 10 parts by weight, per part by weight of the diazo compounds.

The vinyl monomer is included in the core substance of a microcapsule with diazo compounds and, in this case, a part of or all of the organic solvents used as a solvent (or dispersion medium) for the core substance can be substituted with vinyl monomers. The additive amounts of the monomer need not be enough to harden the core substance.

In the case when diazo compounds are included as a core substance in the heat-sensitive recording material of the present invention, an agent which deactivates the coupling reaction is added outside of the microcapsule and the diazo compounds present in the water phase and the diazo compounds present in the capsule which are not completely blocked off by the microcapsule wall are reacted with the deactivating agent, whereby the diazo compounds lose their capacity to undergo a coupling reaction (color-forming reaction) and, therefore, fog can be prevented.

The coupling reaction deactivating agents can be any substances so long as those substances can reduce color formation of a solution having dissolved therein diazo compounds. Whether or not the compound can be used as a coupling reaction deactivating agent can be determined by adding the compound dissolved in water or an organic solvent to the solution of diazo compounds dissolved in water or an organic solvent to see the color change of the diazo compounds.

Specific examples include hydroquinone, sodium bisulfite, potassium nitrite, hypophosphorous acid, stannous chloride, formalin and the like, and can be those selected from examples disclosed in K. H. Saunders, *The Aromatic Diazo-Compounds and Their Technical Applications,* (London) 1949, pp. 105 to 306.

The preferred coupling reaction deactivating agents are those which are less colored themselves and have less side effects, and the most preferred deactivating agents are those which are water-soluble.

The coupling reaction deactivating agents are used in such an amount that they do not impede the heat color-forming reaction of the diazo compounds and generally are used in an amount of from 0.01 to 2 mols, more preferably from 0.02 to 1 mol, per mol of diazo compounds.

The coupling reaction deactivating agents are used in such a manner that the deactivating agents are dissolved in a solvent and then added to the dispersion of microcapsules containing diazo compounds, or into the dispersion of a coupling agent or of a basic substance or a mixture thereof. It is preferred that the deactivating agents are used as an aqueous solution thereof.

In the heat-sensitive recording material of the present invention, pigments such as silica, barium sulfate, titanium oxide, aluminum hydroxide, zinc oxide or calcium carbonate and fine particles such as styrene beads or urea-melamine resin can be used in order to prevent sticking to a thermal head or to improve the writing property. The pigments and fine particles may be used in an amount of from 0.2 to 10 g/m, preferably from 2 to 5 g/m$^2$.

Metal soaps can also be used to prevent sticking and may be used in an amount of 0.2 to 7 g/m$^2$.

In the heat-sensitive recording material of the present invention, a heat-fusible substance can be used to increase heat-recording density The heat-fusible substance is a substance which is solid at an ordinary temperature and has a melting point of from 50° to 150° C. under heating by a thermal head and dissolved diazo compounds, a coupling component or a basic substance. The heat-fusible substance is used as a dispersion having a particle size of from 0.1 to 10 μm and in an amount of from 0.2 to 7 g/m$^2$ (solid content). Specific examples of the heat-fusible substance include N-substituted fatty acid amides, ketone compounds, urea compounds and esters and the like.

A recording layer can be coated by using suitable binders to prepare a heat-sensitive recording material of the present invention.

Binders include various emulsions of polyvinyl alcohol, methyl cellulose, ethyl cellulose, carboxymethyl cellulose, hydroxypropyl cellulose, gum arabic, gelatin, starch and derivatives thereof, polyvinyl pyrrolidone, polystyrene, polyacrylamide, polyester, casein, styrenebutadiene latex, acrylonitrile-butadiene latex, polyvinyl acetate, polyacrylate and a copolymer of ethylene-vinyl acetate. The additive amount may be from 0.5 to 5 g/m$^2$ by solid content.

In addition to the materials described above, citric acid, tartaric acid, oxalic acid, boric acid, phosphoric acid, and/or pyrophosphoric acid can be added as an acid stabilizing agent. The additive amount is from 0.5 to 3 g/m$^2$, preferably 1 to 2 g/m$^2$, by solid content.

The heat-sensitive recording material of the present invention can be prepared by a method which comprises preparing a coating composition containing the main ingredients, such as diazo compounds or a coupling component, and a basic substance and other additives, coating the thus-obtained coating composition on a paper support or a synthetic resin film support by a bar coating method, a blade coating method, an air knife coating method, a gravure coating method, a roll coating method, a spray coating method, a dip coating method and the like and drying it to obtain a heat-sensitive layer having a solid content of from 2.5 to 25 g/m$^2$.

Another method for preparing a heat-sensitive recording material comprises preparing two coating compositions (a first coating composition and a second coating composition), coating the first coating composition on a support and drying it to obtain a precoat layer having a solid content of from 2 to 10 g/m$^2$ and then coating the second coating composition on the precoat layer and drying it to obtain a layer having a solid content of from 1 to 15 g/m$^2$, whereby a laminated layer can be obtained. The first coating composition is prepared by adding a coupling component as a main ingredient, a basic substance and other additives as a core substance of a microcapsule, or dispersing those substances or dissolving those substances in water to prepare an aqueous solution thereof The second coating composition is prepared by adding diazo compounds as a main ingredient and other additives as a core substance of a microcapsule, or dispersing those substances or dissolving those substances in water to prepare an aqueous solution thereof. The first precoat layer and the second layer can be laminated in reverse order. Coating two layers can be done one after another or can be done simultaneously. Such a laminated layer type heat-sensitive recording material is excellent particularly in long term storage stability before recording.

A heat sensitive layer can be coated after an intermediate layer as described in JP-A-No. 61-54980 is provided on a support.

The paper used as a support is preferably a neutral paper having a heat extraction pH of from 6 to 9, which is sized by a neutral sizing agent such as an alkylketene dimer as disclosed in JP-A-No. 55-14281 (corresponding to U.S. Pat. No. 4,255,491), because it provides good storage properties with the passage of time.

To prevent permeation of the coating solution to the paper support and to improve contact between the thermal head and the heat-sensitive recording layer, a paper having Bekk smoothness of 90 seconds or more and meeting the following equation as disclosed in JP-A-No. 57116687 (corresponding to U.S. Pat. No. 4,416,939) is preferred.

$$\frac{\text{Stockigt sizing degree}}{(\text{meter weighing capacity})^2} \geqq 3 \times 10^{-3}$$

A paper having an optical surface roughness of 8 μm or less and having a thickness of from 40 to 75 μm as disclosed in JP-A-No. 58-136492, a paper having a density of 0.9 g/cm$^3$ or less and having optical contact percentage of 15% or more as disclosed in JP-A-No. 58-69091, a paper made of pulp beat-treated at 400 cc or more of Canadian standard freeness (JIS P8121 and treated to prevent permeation of the coating solution as disclosed in JP-A-No. 58-69097, a paper having improved color-forming density and resolving power, whose base paper having a coated gloss surface is prepared by a Yankee machine as disclosed in JP-A-No. 58-65695 (corresponding to U.S. Pat. No. 4,466,007) and a paper whose base paper is corona discharge treated to improve the coating property as disclosed in JP-A-No. 59-35985 can be used and give good results in the present invention. Other supports generally used in the field of heat-sensitive recording papers can be also used in the present invention.

The heat-sensitive recording material of the present invention is used as a print paper for a facsimile and an electronic computer, for which high speed recording is required. After printing is done by heating, unreacted diazo compounds are decomposed by light exposure, whereby fixation can be done.

Furthermore, most preferably, the heat-sensitive recording materials of this invention can be used as so-called heat developable copy papers. A transparent support on which an image has been recorded is superimposed on heat developable copy paper. Then, the paper is exposed to light, after which a color is formed on the unexposed image areas by heating the whole surface. The whole surface of the background of heat-developable copy paper is heated during development and, while yellowing of the background is liable to occur in cases where known basic substances such as triphenylguanidine are used, there is a remarkable improvement in this respect when a basic substance of the present invention is used.

The present invention will be illustrated in more detail by the following Examples, but should not be construed as being limited thereto In the Examples, unless otherwise stated, all parts, percentages, and ratios are by weight.

EXAMPLE 1

3.45 parts of the following diazo compound and 18 parts xylylene diisocyanate and trimethylolpropane adduct (3:1) were added to a mixed solvent of 6 parts tricresyl phosphate and 5 parts ethyl acetate, heated and dissolved.

The resulting solution of the diazo compound was added to an aqueous solution of 5.2 parts polyvinyl alcohol dissolved in 58 parts water and was dispersed and emulsified at 20° C. to obtain a solution of an emulsion having an average particle size of 2.5 μm.

100 parts of water was added to the resulting solution of the emulsion and heated to 60° C. while stirring and in 2 hours, a capsule solution having the diazo compound included in a core substance was obtained.

Diazo Compound

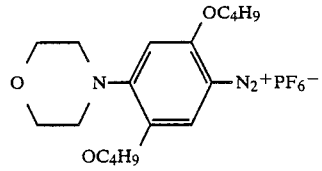

10 parts of naphthol AS and 10 parts of N,N′-bis(3-phenoxy-2-hydroxypropyl)piperazine were added to 100 parts of a 5% aqueous polyvinyl alcohol solution and were dispersed by a sand mill for about 24 hours to obtain a dispersion of a coupling component and a basic substance having an average particle size of 3 μm.

20 parts of p-benzyloxyphenol was added to 100 parts of a 4% aqueous polyvinyl alcohol solution and 100 parts water was added thereto and they were dispersed for 2 hours by a paint shaker to obtain a dispersion having an average particle size of 3 μm.

24 parts of the dispersion of the coupling component and the basic substance, and 28 parts of the dispersion of p-benzyloxyphenol were added to 50 parts of the capsule solution of the diazo compound thus-obtained to prepare a coating solution. The coating solution was coated using a coating bar on a smooth high quality paper (50 g/m$^2$) so that the dry weight was 10 g/m$^2$, and was dried at 25° C. for 30 minutes to obtain a heat-sensitive material.

COMPARATIVE EXAMPLE 1

A heat-sensitive recording material was obtained in the same manner as in Example 1 except that triphenylguanidine was used in place of the N,N′-bis(3-phenoxy-2-hydroxypropyl)piperazine used in Example 1.

TEST METHOD

Heat recording was conducted on the thus-obtained heat-sensitive recording materials in Example 1 and Comparative Example 1 using a GIII Mode Thermal Printer ("Hi-Fax 700", a trade name, manufactured by Hitachi, Ltd.) and the entire surface area of each sample was exposed to light for fixation using Ricopy Super Dry 100, manufactured by Ricoh Co., Ltd. The blue density of the thus-obtained recorded images and the yellow density of the background were measured by a Macbeth reflective densitometer.

Attempts were made to re-record on the fixed portions but in neither Example 1 nor Comparative Example 1 were a recording obtained, and it was confirmed that fixation had been achieved in each case.

Next, the background densities (fog formation) of heat-sensitive recording materials which had been stored for 24 hours of 60° C. and 30% relative humidity (RH), or at 40° C. and 90% RH, and the yellow density of the background of heat-sensitive recording materials which had undergone a forced deterioration test performed by irradiating the heat sensitive recording materials with light for 24 hours in a "Xenon Long Life Fadometer" (FAL-25 AX-HC model, made by Suga Shikenki) were measured using a Macbeth reflection densitometer, and the change in the coloration of the background was noted in order to observe the shelf life stability before recording of the heat-sensitive recording materials.

Next, the images recorded on the heat sensitive recording materials were stored for 16 hours in a dark place at 60° C., and after carrying out the forced deterioration test, the extent of the recorded image's drop in density was assessed in order to investigate the drop in optical density of the colored portions due to long term storage after thermal recording. The results obtained are shown in Table 1.

TABLE 1

| Example No. | Image Density | Drop in Density after Forced Degradation Test |
|---|---|---|
| Example 1 | 1.26 | Less than 5% |
| Comparative Example 1 | 1.26 | " |

The results obtained by measuring the coloration of the background portion are shown in Table 2.

TABLE 2

| Example No. | Yellow Density of Background | Storage Stability before Recording | Yellow Density of Background after Exposure to Light |
|---|---|---|---|
| Example 1 | 0.08 | 0.10* 0.12** | 0.12 |
| Comparative Example 1 | 0.12 | 0.15* 0.16** | 0.33 |

*Coloration density of background after 24 hours storage under conditions of 60° C. and 30% RH.
**Coloration density of background after 24 hours storage under conditions of 40° C. and 90% RH.

EXAMPLE 2

An example of a heat developable type heat-sensitive copy paper of the present invention is described in detail below.

3.45 parts of the following diazo compound and 18 parts xylylene diisocyanate and trimethylolpropane adduct (3:1) were added to a mixed solvent of 24 parts tricresyl phosphate and 5 parts ethyl acetate, heated and dissolved.

The resulting solution of the diazo compound was added to an aqueous solution of 5.2 parts polyvinyl alcohol dissolved in 58 parts water and was dispersed and emulsified at 20° C. to obtain a solution of an emulsion having an average particle size of 1.5 μm.

100 parts of water was added to the resulting solution of the emulsion and heated to 60° C. while stirring and in 2 hours, a capsule solution having the diazo compound included in a core substance was obtained.

Diazo Compound

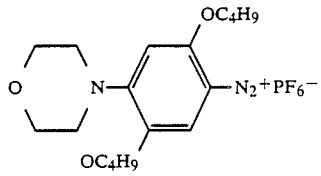

20 parts of naphthol AS and 20 parts of N,N-bis-(3-phenoxy-2-hydroxypropyl)piperazine were added to 100 parts of a 5% aqueous polyvinyl alcohol solution and were dispersed by a sand mill for about 24 hours to obtain a dispersion of coupling component and triphenyl quanidine having an average particle size of 3 μm.

6 parts of the dispersion of the coupling component and the basic substance were added to 50 parts of the capsule solution of the diazo compound thus-obtained to prepare a coating solution. The coating solution was coated using a coating bar on a smooth high quality paper (50 g/m$^2$) so that the dry weight was 6 g/m$^2$, and was dried at 25° C. for 30 minutes to obtain a heat-sensitive material.

EXAMPLE OF SYNTHESIS 1

The N,N'-bis(3-phenoxy-2-hydroxypropyl)piperazine used in Examples 1 and 2 was prepared in the following manner.

86 g (1 mol) of anhydrous piperazine was weighed out into a 1 liter three necked flask, 500 ml of ethyl acetate was added and the anhydrous piperazine was dissolved by stirring while heating the flask on a steam bath. Next, 315 g (2.1 mol) of phenyl glycidyl ether was added dropwise over a period of about 30 minutes, after which the mixture was reacted for a period of 2 hours at 75° C. On completion of the reaction, the mixture was cooled and the white crystals which formed were filtered off and washed twice with 50 ml of cold ethyl acetate. On drying, 347 g of the target compound was obtained. (Yield: 90%). The target compound has a melting point of 91° C.

The target compound was obtained in a similar yield by this reaction when 407 g (2.1 mol), of inexpensive piperazine hexahydrate which is widely available was used and reacted in exactly the same manner in place of the anhydrous piperazine.

COMPARATIVE EXAMPLE 2

A heat sensitive recording material was obtained in the same manner as in Example 2 except that triphenylguanidine was used in place of the N,N'-bis(3-phenoxy-2-hydroxy-propyl)piperazine used in Example 2.

TEST METHODS

The heat-sensitive recording materials obtained in Example 2 and Comparative Example 2 were subject to an image exposure using a "Ricopy Super Dry 100" (made by the Ricoh Co., ltd.), after which the whole surface of the each of these materials was heated to 150° C. for a period of 5 seconds using a hot plate. The blue densities of the recorded images obtained were measured using a Macbeth reflection densitometer. In addition, the yellow density of the base portion was measured in the same way.

Next, the color densities were measured after storing for 24 hours at 60° C. and 30% RH, and at 40° C. and 90% RH in order to investigate the shelf life stability before recording.

The heat-sensitive recording materials on which recordings had been made were exposed to light for 24 hours in a "Xenon Long Life Fadometer" (FAL-25AX·HC model, made by the Suga Shikenki Co.), and after carrying out the forced deterioration test, the image densities were measured using a Macbeth reflection densitometer in order to observe the image's fastness to light. Furthermore, heat-sensitive recording materials on which recordings had been made were stored in the dark for 24 hours at 50° C. and 90% RH, and the image densities were measured after the materials were subjected to the forced deterioration test. This measurement was made in order to observe the image's fastness to temperature and humidity.

Next, heat-sensitive recording materials on which recordings had been made were exposed to light for 24 hours in a "Xenon Long Life Fadometer" (FAL-25AX·HC model, made by the Suga Shikenki Co.) in the same manner used for investigating the fastness of the image to light. The yellow densities of the background were measured with a Macbeth reflection densitometer after the materials were subjected to the forced deterioration test in order to the observe the coloration of the background.

In addition, the heat-sensitive recording materials on which recordings had been made were stored in the dark for 24 hours at 50° C. and 90% RH, and the yellow densities of the background were measured with a Macbeth reflection densitometer after the materials were subjected to the forced degradation test in order to observe the coloration of the background due to temperature and humidity after recording.

The results obtained are shown in Tables 3 to 5.

TABLE 3

(Color Forming Properties and Fresh Storage Properties)

| Example No | Color Density | Color Density after Storage: 24 hrs, 60° C. 30% RH | Color Density after Storage: 24 hrs, 40° C. 90% RH |
|---|---|---|---|
| Example 2 | 1.14 | 1.08 | 1.09 |
| Comparative Example 2 | 1.13 | 1.07 | 1.07 |

TABLE 4

(Image Fastness)

| Example No. | Image Density after 24 hrs Exposure in Fadometer | Image Density after 24 hrs Dark Storage at 50° C., 90% RH |
|---|---|---|
| Example 2 | 0.72 | 1.14 |
| Comparative Example 2 | 0.54 | 1.10 |

TABLE 5

| Example No. | Yellow Density of Background Immediately after Recording | Yellow Density of Background after 24 hrs Exposure in Fadometer | Yellow Density of Background after 24 hrs Storage at 50° C., 90% RH |
|---|---|---|---|
| Example 2 | 0.120 | 0.185 | 0.125 |
| Comparative | 0.140 | 0.206 | 0.143 |

TABLE 5-continued

| Example No. | Yellow Density of Background Immediately after Recording | Yellow Density of Background after 24 hrs Exposure in Fadometer | Yellow Density of Background after 24 hrs Storage at 50° C., 90% RH |
|---|---|---|---|
| Example 2 | | | |

It is clear from these results that the heat sensitive recording materials of this invention have excellent color forming properties, fresh storage properties and image fastness, and that they are also superior in that there is little coloration of the background portions.

While the present invention has been described in detail and with reference to specific embodiments thereof, it is apparent to one skilled in the art that various changes and modifications can be made therein without departing from the spirit and the scope of the present invention.

What is claimed is:

1. A heat-sensitive recording material comprising a support having thereon a heat-sensitive recording layer which comprises (a) a diazo compound, (b) a coupling component which forms a coloration by coupling with the diazo compound, and (c) a basic substance having a structural unit represented by Formula (IV):

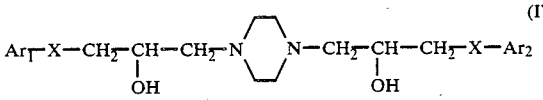

(IV)

wherein X represents O or S; and $Ar_1$ and $Ar_2$ each represents a phenyl group or a naphthyl group, which group may be substituted or unsubstituted.

2. A heat-sensitive recording material as in claim 1, wherein the basic substance has a melting point of from 60° C. to 200° C.

3. A heat-sensitive recording material as in claim 2, wherein the basic substance has a melting point of from 80° C. to 140° C.

4. A heat-sensitive recording material as in claim 1, wherein the basic substance is sparingly soluble in water and has excellent compatibility with the coupling component.

5. A heat-sensitive recording material as in claim 1, wherein the diazo compound is a diazonium salt represented by the formula $ArN_2^+X^-$, wherein Ar represents an aromatic moiety, $N_2^+$ represents a diazonium group and $X^-$ represents an acid anion.

6. A heat-sensitive recording material as in claim 10, wherein Ar is represented by the Formula (VI):

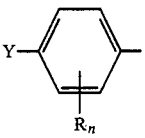

(VI)

wherein Y represents a hydrogen atom, a substituted amino group, a nitrogen atom of a nitrogen atom-containing ring, an alkoxy group, an aryloxy group, an arylthio group, an alkylthio group, or an acylamino group; R represents a hydrogen atom, an alkyl group, an alkoxy group, an aryloxy group, an arylamino group, which groups may be substituted or unsubstituted, or a halogen atom; and n is 1 or 2.

7. A heat-sensitive recording material as in claim 1, wherein the diazo compound is present in an amount of from 0.05 to 5.0 grams per square meter of the heat-sensitive recording material.

8. A heat-sensitive recording material as in claim 1, wherein the coupling component is present in an amount of from 0.1 to 10 parts by weight per 1 part by weight of the diazo compound.

9. A heat-sensitive recording material as in claim 1, wherein the basic substance is present in an amount of from 0.1 to 20 parts by weight per 1 part by weight of the diazo compound.

10. A heat-sensitive recording material as in claim 1, wherein the diazo compound, the coupling component, and the basic substance are combined in a water-soluble polymer in the form of a solid dispersion, wherein the concentration of the water-soluble polymer is from 2 to 30 wt% of the dispersion, and one of (a) the diazo compound, (b) the coupling component or (c) the basic substance is present in an amount of from 5 to 40 wt% per the weight of the water soluble polymer solution.

* * * * *